United States Patent [19]

Mason

[11] 4,105,178

[45] Aug. 8, 1978

[54] DRUM STAND

[76] Inventor: Harold F. Mason, P.O. Box 10139, Tampa, Fla. 33679

[21] Appl. No.: 782,923

[22] Filed: Mar. 30, 1977

Related U.S. Application Data

[63] Continuation of Ser. No. 696,779, Jun. 16, 1976, which is a continuation-in-part of Ser. No. 583,437, May 30, 1975, abandoned.

[51] Int. Cl.[2] ..... A47G 23/02

[52] U.S. Cl. ..... 248/151; 248/150; 248/188

[58] Field of Search ..... 248/150, 151, 188, 165, 248/166, 434, 435, 439; 229/1.5 B, 166; 220/65, 85 H; 240/52.5

[56] References Cited

U.S. PATENT DOCUMENTS

| | | | |
|---|---|---|---|
| 922,503 | 5/1909 | Perelzveich | 248/151 |
| 1,622,506 | 3/1927 | Graves | 248/151 |
| 2,671,628 | 3/1954 | Everhard | 248/151 |

FOREIGN PATENT DOCUMENTS

| | | | |
|---|---|---|---|
| 695,333 | 5/1930 | France | 248/150 |
| 19,157 | 6/1956 | Fed. Rep. of Germany | 248/150 |
| 298,562 | 6/1932 | Italy | 248/150 |

*Primary Examiner*—Robert Hafer

*Attorney, Agent, or Firm*—Stefan M. Stein; Robert F. Frijouf

[57] ABSTRACT

A stand device used in combination with a container such as a drum having substantially cylindrical configuration wherein at least two support legs are movable into and out of supporting relation. Each of the supporting legs comprises a configuration substantially corresponding to the exterior surface of the container such that in its non-supporting position, the legs are disposed in substantially flush engagement with the exterior surface due to an indentation formed in the exterior surface corresponding to the dimension and thickness of the leg means.

4 Claims, No Drawings

DRUM STAND

This is a continuation of application Ser. No. 696,779, filed June 16, 1976 which was a continuation-in-part of application Ser. No. 583,437, filed May 30, 1975, now abandoned.

BACKGROUND OF THE INVENTION

1. Field of the Invention

This invention is directed to a supporting device in the form of a stand or like structure movably connected to a container so as to be positioned in both supportive and non-supportive position relative to the container and configured when in its non-supportive position to substantially conform to the configuration of the container in order to facilitate storage and/or transportation.

2. Description of the Prior Art

There are present in the prior art and also commercially available a number of various types of support devices in the form of stands, braces, platforms, etc., designed to maintain containers of various types and configuration in a given supportive attitude or position.

Normally, however, such stands are an auxiliary structure which is not accompanying a given container. This is especially true with the larger size containers holding both liquids and solids. The use of large drum-like containers frequently requires some type of support device when the contents of these containers are utilized or used up on a gradual basis. In utilizing these containers, when support devices are required, it has been found to be an obvious inconvenience to procure various types of auxiliary or makeshift stands. Such commercially available prior art devices are generally represented in the U.S. Pat. Nos. to Young, 1,375,403, Marcus, 2,177,073, Mayor, 2,466,323, Emory, 2,746,703, Shelby, 2,846,708, Brenner, 3,013,757, Jay, 3,476,260, Schnider, 3,747,780, and Rasmussen, 1,476,542.

In addition, Italian Pat. No. 298,562 and German Pat. No. M19,157 both show supporting legs for a cylindrical container or drum which when not in supporting position may be wrapped around the curved surface of the container. However in both cases the support structure, when not in supportive position, protrudes from the outer surface of the drum or container.

Accordingly, there is a need for a container having an attached supporting device or stand capable of maintaining the container in a predetermined orientation. Such a supporting device should be structured and configured for disposal in a non-interferring position relative to the intended use of the container during its storage, transportation and various uses.

Moreover, it would be desirable to have the supporting structure, while in a non-supportive position, fitted into the overall contour of the container.

It is an object of this invention therefore to provide a supportive structure for cylindrical containers, such as drums, which, when in a non-supportive position, such as for transportation or storage, will have the supportive structure contained within a recess in the overall outer configuration or contour of the drum so that it will not occupy more space than the original drum and also so that it may be moved by rolling on its cylindrical face. As a discarded drum, it may be used as a barbecue cooker.

These and other objectives as well as other advantages will be apparent from the detailed description hereinafter presented.

SUMMARY OF THE INVENTION

This invention is directed to a support device of the type used in combination with and attached to a container. For purposes of illustration and explanation the subject invention is described with reference to a cylindrically configured drum-like container. However, it is intended that the structure which is the subject of the present invention, can be utilized with containers of various sizes and configuration while still including the basic inventive structure set forth hereinafter.

The support device comprises supporting means in the form of at least two support means or structures movably attached to the outer surface of the container being supported. These may be made from a second drum. The support means are connected to the exterior surface of the container by a base means serving to connect correspondingly disposed portions of the plurality of support means. The base means itself may take a variety of configurations corresponding to the particular configuration of the support portion which it engages. The base means itself is attached to the exterior of the container and fits within depressions in the outer wall of the contour so that it does not protrude from or beyond the other configuration of the container. Being movably connected in this manner, each of the support means is movable into and out of a container supporting position relative to the ground or surface on which the container is intended to be positioned. As will be described in greater detail hereinafter, the non-supportive position is defined by each of the support elements disposed in substantially flush relation to corresponding portions of the exterior surface of the container. Accordingly, each of the support elements has a configuration which essentially corresponds to the outer surface of the container.

In at least one of the embodiments of the present invention, each of the support means comprises a substantially arcuate configuration which corresponds with the cylindrical configuration of the outer surface of the drum-like container.

The container means further comprises indentation or recessed means having a shape or configuration generally similar or compatible with the overall configuration of the support means. Accordingly, when the support means are rotated or moved into their non-supportive relation they are maintained within the indentation so as to define a substantially flush outer surface of the container. In this manner, the container, with the support means in their non-supportive position, may be stored, transported, or otherwise maintained in a normal fashion in that the support means are positioned to substantially correspond with the overall configuration and not protrude therefrom in an interruptive fashion.

A retention means may be further interconnected between each of the support legs when they are positioned in their supportive relation relative to the container. In this manner, the support means are "locked" in their supportive position and the container is securely supported thereon. This prevents the inadvertent or accidental movement of the support means into their non-supportive position.

This invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 2:
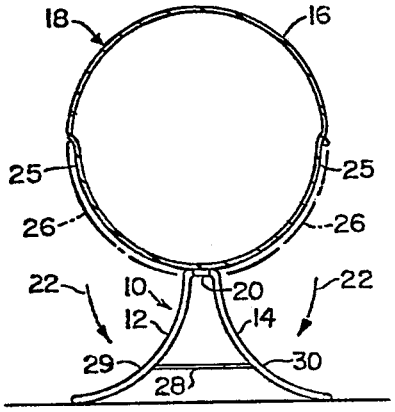
FIG. 2 is a sectional view taken along line 2—2 of FIG. 1.
Figure 5:
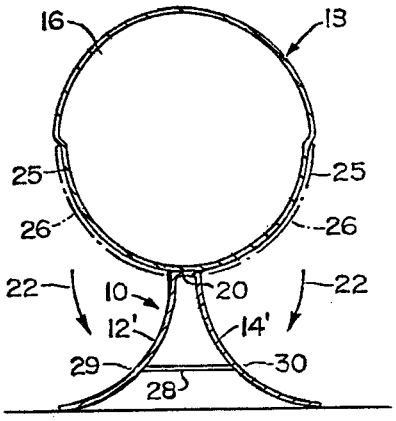
FIG. 5 is a section view along line 5—5 of FIG. 4.

As shown, the support device of the present invention is generally indicated as 10. The device comprises leg support means including at least two leg elements 12 and 14. Each leg element is movably attached to the exterior surface 16 of container 18. More specifically, a base means 20 may take a plurality of configurations but is fixedly attached to the exterior surface 16 of container 18 and also is disposed to interconnect corresponding extremities or portions of the leg means 12 and 14. This disposition serves to allow pivotal or rotational movement relative to the surface as indicated by directional arrows 22. As best shown in FIGS. 2 and 5, each of the leg elements 12 and 14 are correspondingly configured to the exterior surface 16 of the container 18. In the particular embodiment shown, the configuration of leg means 12 and 14 is substantially arcuate so as to correspond to the cylindrical surface 16 as shown.

An indentation means is formed in the exterior surface. This indentation means 25 has a depth substantially corresponding to the thickness or width of each of the prospective leg means 12 and 14 mounted therein. The non-supporting position as represented in broken lines and indicated as 26 is defined by the leg elements 12 and 14 formed within the indentation means 25.

Retention means 28 may be disposed in interconnecting relation between the various leg portions 12 and 14. By virtue of this arrangement, the leg elements 12 and 14 are "locked" in the position shown in FIGS. 2 and 5. This serves to maintain the leg elements in the container supportive position as represented and thereby prevent or reduce the possibility of inadvertent collapse of the leg elements upwardly into its non-supportive position. The retention means 28, as shown, has its opposite extremities 29 and 30 attached to the opposite legs at any given applicable location.

Figure 1:
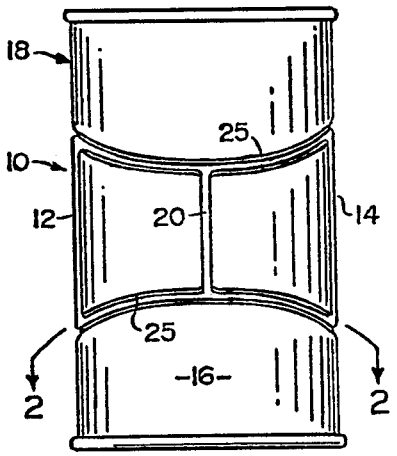
FIG. 1 is a bottom plan view showing the support means of the present invention in supporting position.
Figure 4:
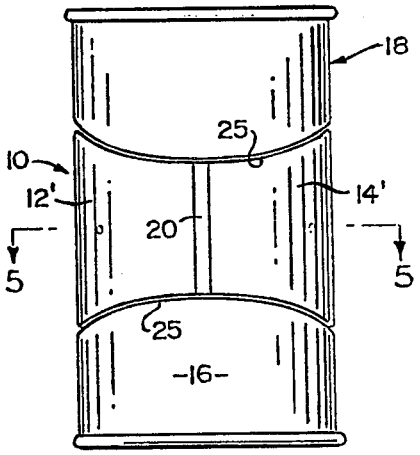
FIG. 4 is a bottom plan view of yet another embodiment of the present invention.
Figure 3:
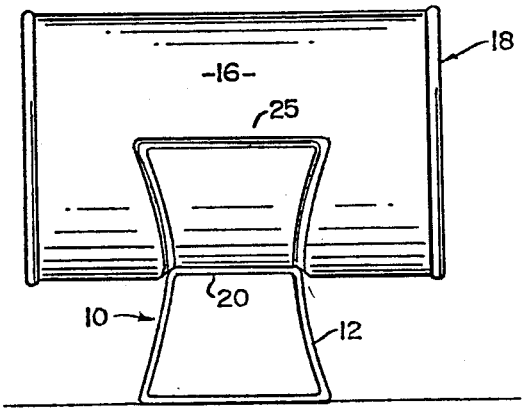
FIG. 3 is a side view of the embodiment shown in FIGS. 1 and 2.
Figure 7:
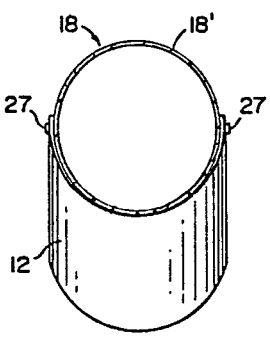
FIG. 7 is a sectional view taken along line 7—7 of FIG. 6.

One embodiment of the present invention as best shown in FIGS. 1 and 3 has the individual leg or support elements formed of a substantially elongated stock wherein the configuration defines a curvilinear path along the length of the individual legs 12 and 14.

In another embodiment of the present invention the individual leg elements 12 and 14 comprise a sheet-like material have a substantially curvilinear configuration corresponding to the outer surface of the container 18 as set forth above. In this embodiment, the indentation means 25 has a substantially planar configuration corresponding to the curvilinear but planar or cylindrical configuration of each of the leg elements 12' and 14' shown in the embodiments represented in FIGS. 1 and 5. Alternatively, the embodiments of FIGS. 1, 2 and 3 has the indentation means 25 in a substantially groove or track-like configuration corresponding to the configuration of the elongated stock forming each of the leg elements 12 and 14.

Figure 6:
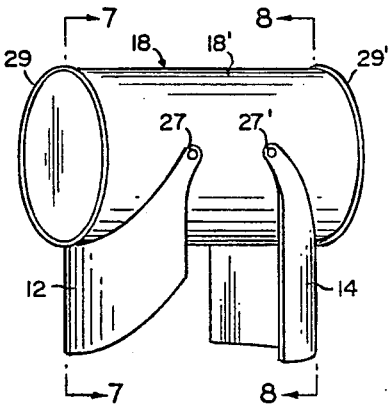
FIG. 6 is a side perspective view of another embodiment of the support means of this invention in supporting position.
Figure 8:
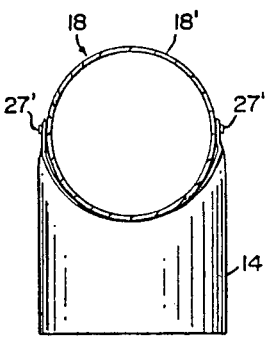
FIG. 8 is a sectional view taken along line 8—8 of FIG. 6.
Figure 9:
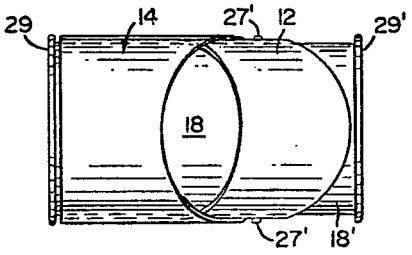
FIG. 9 is a bottom plan view of the embodiment of FIG. 6 taken with the supportive means in non-supportive position.
Figure 10:
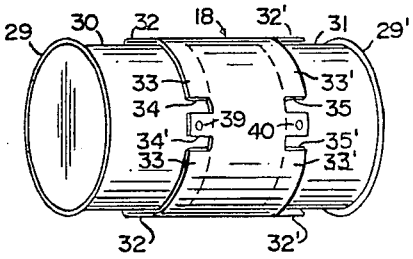
FIG. 10 is a bottom plan view showing another embodiment of a container arrangement of this invention.

In still another embodiment as shown in FIGS. 6–9, the support means comprise legs 12 and 14 which are curved in shape to fit over the cylindrical configuration of the container 18 and are attached to the cylindrical wall 18 by bolts 27 and 27' which are welded to the cylindrical wall 18 and are fitted through openings in legs 12 and 14 so that these legs may be pivoted from the supportive position shown in FIG. 6 and the non-supportive position shown in FIG. 9. In FIG. 9, leg 12 is pressed against the cylindrical wall 18' and leg 14 laps over a part of leg 12 and also is pressed against the cylindrical wall 18'. Leg 14 has a curved protruding section 28 which gives a greater radius to the arc forming the curved surface of leg 14 thereby allowing leg 14 to fit over leg 12 when the two are not in a supportive position. Furthermore leg 12 is of an appropriate length so that it may be put into its non-supportive position while leg 14 is in the supportive position. Then leg 14 may be pivoted from its supportive position to its non-supportive position.

Rims 29 and 29' extend from the cylindrical wall 18' and the two thicknesses of legs 12 and 14 and the bolts 27 and 27' all fit within the overall cylindrical configuration determined by the two rims. Thus the cylindrical container 18 may be rolled on the two rims with no part of legs 12 and 14 or bolts 27 and 27' protruding beyond this outer cylindrical configuration to interfere with rolling of the drum container. Moreover, when such drums are stored on end for storage in a warehouse or in transportation on a truck or freight car, there is no extra space required because of any protrusions beyond this cylindrical configuration.

Figure 11:
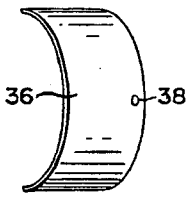
FIGS. 11 and 12 show individual perspective views of supporting legs for the embodiment of FIG. 10.
Figure 12:
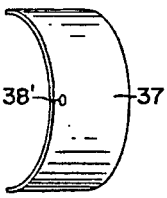

In still another embodiment, as shown in FIGS. 10–15, the outer cylindrical wall of container 18 has two indented or recessed areas 20 and 31 at opposite ends but in the same side of the cylindrical wall of the drum. These indented areas or recessed areas of the cylindrical wall have lips 32 and 33 projecting over the recessed area at one end of the drum and lips 32' and 33' projecting over the recessed area at the opposite end of the drum. In lip 33 there are two slots, 34 and 34', extending from substantially the entire width of the lip. Likewise in lip 33' there are two slots 35 and 35' extending substantially the entire width of lip 33'. The supportive legs 36 and 37 are shown in FIGS. 11 and 12. Each of these legs are curved to fit the cylindrical contour of the recessed areas 30 and 31, respectively, and each has a bump or dimple 38 or 38' in the outer configuration.

Figure 13:
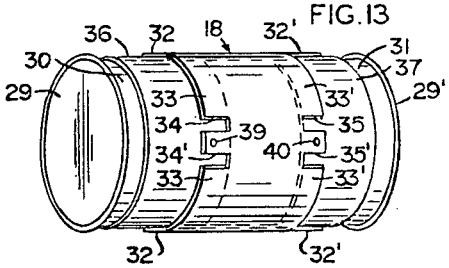
FIG. 13 shows a bottom plan view of the embodiment of FIG. 10 with the supportive legs of FIGS. 11 and 12 installed in non-supportive storage position.

FIG. 13 shows these legs 36 and 37 fitted in a non-supportive position in the recessed areas 30 and 31 and slid into holding contact between the respective recessed areas 30 and lips 32 and 33 in one case and recessed area 31 and lips 32' and 33' in the other case. Bump or dimple 38 or 38' is pressed into holding relationship with indentation 39 or 40, respectively. The fitting of the respective bumps or pimples into the corresponding indentations prevents the legs 36 and 37 from being easily dislodged from the recessed areas as described above.

Figure 14:
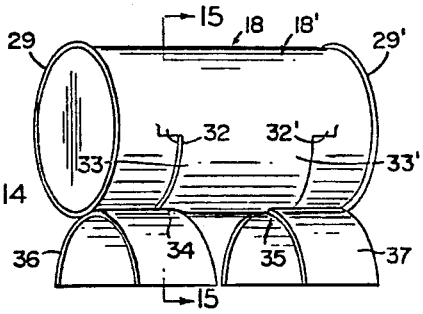
FIG. 14 shows a side perspective view of the container with the legs in supportive position.
Figure 15:
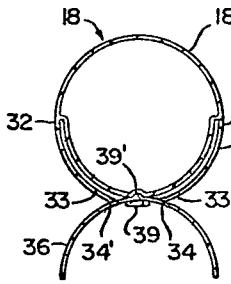
FIG. 15 shows a sectional view taken at line 15—15 of FIG. 14.

FIG. 14 shows this same modification with the legs 36 and 37 fitted into supportive position with the manner of fitting shown in greater detail in FIG. 15 which is a sectional view taken at line 15—15 of FIG. 14. Leg 36 is reversed in position from that shown in FIG. 13 and has one edge inserted into slots 34 and 34' so that container 18 will not roll off the curved supporting surface of leg 36. The bump 38 is now pressed and fitted into an indentation 39' in the recessed wall of the container. A tight fitting of this bump and indentation prevents the leg from sliding forward and being dislodged from its supportive arrangement with the container. Leg 37 is similarly fitted into slots 35 and 35' and held in supportive position by the fitting of bump 38' into an indentation similar to 39' in the recessed area 31. Other means for holding the container firmly to the supportive legs will be obvious.

As may be seen the legs when in a non-supportive position fit into the outer cylindrical configuration of the container so that there are no protrusions which will interfere with rolling of the drum nor will there be any additional space required for storage of the containers because of protrusions.

It will thus be seen that the objects made apparent from the preceding description are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features herein described, and all statements of the cope of the invention which, as a matter of language, might be said to fall therebetween.

Now that the invention has been described, what is claimed is:

1. A support device in combination with a substantially cylindrical container having an external surface including indentation means formed in inset relation to the exterior surface of the container, said indentation means extending about a substantial portion of the substantially cylindrical container, said support device comprising:

first and second support leg means each having an arcuate configuration substantially corresponding to the curved surface of the substantially cylindrical container;

lip protection means secured relative to the substantially cylindrical container and disposed in relation to said indentation means to receive said first and second support leg means in a supporting and a non-supporting position;

said lip projection means securing each of said leg means relative to the container when said leg means are maintained in said supporting position to support the container thereby; and said lip projection means securing each of said leg means within said indentation means when said leg means are maintained in said non-supporting position;

2. A device as set forth in claim 1, wherein:

said indentation means has a depth dimension substantially equal to the thickness of each of said first and second support leg means enabling the container to be rolled when said first and second support leg means are positioned in said indentation means in the non-support position.

3. A support device as in claim 1, wherein each of said leg element is formed from substantially sheet stock having a curvature conforming to the outer curved surface of a cylindrical drum to which it is to be attached.

4. A support device as in claim 1, wherein said non-supporting position is defined by substantially flush engagement between said support leg means and the exterior surface of said container means.

* * * * *